United States Patent [19]

Moretti et al.

[11] Patent Number: 4,619,254

[45] Date of Patent: Oct. 28, 1986

[54] PROTECTIVE RESPIRATOR HOOD WITH INNER AND OUTER BIBS

[75] Inventors: Anthony L. Moretti, San Rafael; Anselmo P. Pellolio, Jr., Cotati, both of Calif.

[73] Assignee: E. D. Bullard Company, Sausalito, Calif.

[21] Appl. No.: 615,090

[22] Filed: May 29, 1984

Related U.S. Application Data

[63] Continuation-in-part of Ser. No. 457,527, Jan. 13, 1983, Pat. No. 4,484,575.

[51] Int. Cl.[4] ..... A62B 7/00

[52] U.S. Cl. ..... 128/201.23

[58] Field of Search ..... 128/201.23, 201.25, 128/201.29; 2/2.1 A, 202, 205

[56] References Cited

U.S. PATENT DOCUMENTS

| | | | |
|---|---|---|---|
| 645,286 | 3/1900 | Bader | 128/201.23 |
| 2,810,385 | 10/1957 | Reed | 128/201.23 |
| 3,955,570 | 5/1976 | Hutter, III | 128/201.23 |
| 4,236,514 | 12/1980 | Moretti | 128/201.23 |
| 4,458,680 | 7/1984 | Childers et al. | 128/201.23 |
| 4,484,575 | 11/1984 | Brockway et al. | 128/201.23 |

*Primary Examiner*—Henry J. Recla

*Attorney, Agent, or Firm*—Thomas M. Freiburger

[57] ABSTRACT

A head mounted, protective respirator hood is improved by the addition of an inner bib structure. Embodiments of the improved hood for use with half or full face respirator masks as well as for use as a supplied air respirator hood are disclosed. An elasticized opening through the inner bib adapting the improved hood structure for mounting to a variety of different face masks is described. The use of a rigid neck ring to attach the inner bib to the neck opening of a protective suit is disclosed.

7 Claims, 17 Drawing Figures

PROTECTIVE RESPIRATOR HOOD WITH INNER AND OUTER BIBS

REFERENCE TO RELATED APPLICATION

This application is a continuation-in-part of application Ser. No. 457,527, filed Jan. 13, 1983, now U.S. Pat. No. 4,484,575 issued Nov. 27, 1984, assigned to the same assignee as this application.

BACKGROUND OF THE INVENTION

1. Field of the Invention

This invention relates to protective head enclosures of the type worn by those working in atmospheres contaminated with airborne substances and more particularly to an improved, inexpensive, lightweight, air-impervious, loose fitting hood having a double bib structure which may be adapted for use with half or full face mask type respirators as well as for positive pressure use.

2. Prior Art

Health and safety requirements dictate that those working in atmospheres contaminated with airborne substances utilize at least an appropriate device for providing contaminant free respiration air. Such devices may take the form of a face mask designed to engage the nose and mouth of the wearer provided with a filter for removing contaminants from air drawn therethrough during normal respiration and with or without a lens structure for protecting the eyes of the wearer. Such devices do not protect the head, neck and ears of the wearer from airborne contaminants. Thus, various hood structures providing full head enclosure have been proposed which are either supplied with clean air from a pressurized source to form a positive plenum of respirable air therewithin or adapted for use in conjunction with a face mask device.

However, in order to obtain the full benefit of such a hood structure, it is necessary to somehow integrate the hood with the body covering apparel of the wearer. To this end, in the prior art, the hood was provided with a bib structure which could be tucked inside the body covering apparel of the wearer or sealingly attached directly to the body covering apparel of the wearer about the neck of the wearer. Such an arrangement is inconvenient and uncomfortable even where the bib is of substantial length because it inhibits the hood from turning with the head of the wearer. It has been proposed to support the hood independently of the head of the wearer. However, such arrangements have interfered with the visual activities of the wearer even where an oversize lens is provided and tend to complicate the hood structure.

It is a primary object of this invention to provide an improved head mounted hood structure which may be used with a face mask without detracting from the convenience and comfort of the face mask and without adding undesirable cost. It is an alternate object of this invention to provide an improved head mounted positive pressure hood structure having the convenience and comfort of a face mask at comparable or reduced expense.

SUMMARY OF THE INVENTION

This invention is an improved head-mounted hood of the type including a hollow, generally tubular body portion with a closed end and an open end made of flaccid, non-stretchable, air-impervious material dimensioned to enclose the head and neck of the wearer and having an optical lens panel interposed in the side wall adjacent the closed end thereof. The improvement comprises an elongated, open-ended, generally tubular inner bib structure of flaccid, non-stretchable, air-impervious material dimensioned to be received over the head of the wearer. One end of the tubular inner bib structure is sealingly affixed about the inner surface of the tubular body portion intermediate the closed end and the open end thereof on the opposite side of the optical lens panel from such closed end. The tubular inner bib structure extends in overlapping substantially coaxial relation within the tubular body portion and projects a substantial distance from the open end thereof. According to one embodiment of this invention, the end of the inner bib structure is sealingly affixed about the inner surface of the tubular body portion by means of an annular air distribution ruff. According to another embodiment of this invention, an elasticized opening is provided through the front of the inner bib structure to accommodate the filter and exhaust port of a face mask worn by the wearer of the hood.

BRIEF DESCRIPTION OF THE DRAWING

The foregoing and other objects and features of this invention will be more fully understood from the following detailed description of the invention when read with reference to the attached drawings wherein.

DETAILED DESCRIPTION OF PREFERRED EMBODIMENTS

Figure 1:
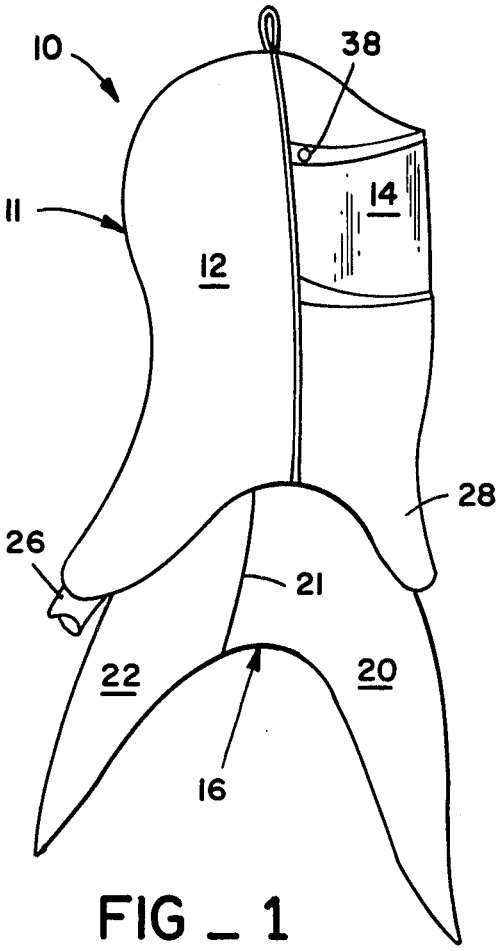
FIG. 1 is a side view in elevation of a first embodiment of the protective respirator hood including inner and outer bibs according to the improvement of this invention prior to being donned by the wearer.

Referring to FIG. 1, an embodiment 10 of the improvement of this invention as applied to a positive pressure supplied air respirator hood 11 is shown prior to donning by the wearer. The supplied air respirator hood 11 is preferably of the type disclosed in co-pending U.S. patent application Ser. No. 457,527, filed Jan. 13, 1983, now U.S. Pat. No. 4,484,575 assigned to the assignee of this application. According to the teaching of that patent, the hood 11 comprises a hollow, generally tubular body portion 12 closed at one end and made of flaccid, non-stretchable, air-impervious material dimensioned to enclose the head and neck and drape over the shoulders of the wearer. A curved optical lens panel 14 transparent to light in a given frequency and intensity range is interposed in the side wall of the body portion 12 adjacent the closed end thereof. The teaching of the above-referenced patent with respect to the construction of the hood 11 is incorporated herein by reference.

According to the improvement of this invention, the hood 11 is provided with an inner bib structure 16. The inner bib structure 16 is an elongated open-ended, generally tubular structure of flaccid, non-stretchable, air-impervious material dimensioned to be received over the head of the wearer. The inner bib structure may be made of polyolefin scrim about 3 mils thick with a polyolefin or polyethelene coating as sold by Dow Chemical Co. under the trademark TYVEX, for example, or of vinyl sheeting five to eight mils thick with or without scrim.

Figure 2:
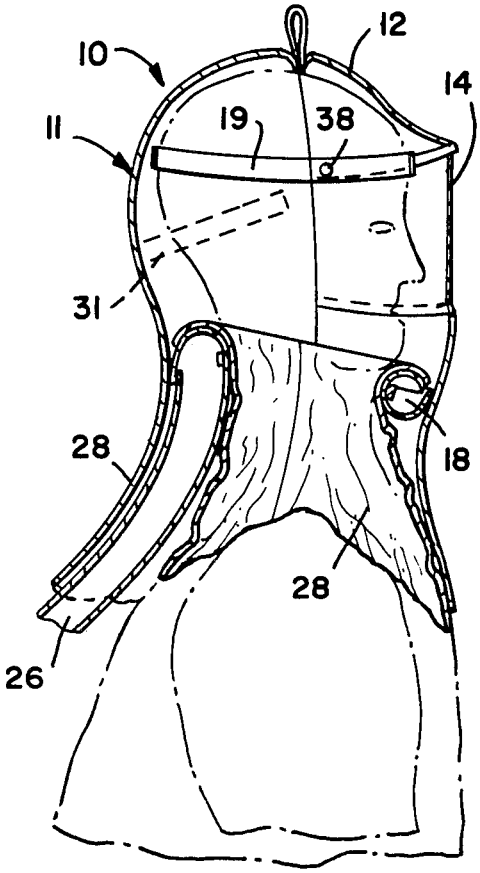
FIG. 2 is a cross-sectional view of FIG. 1 showing the improved protective respirator hood after being donned by the wearer.

As best shown in FIG. 2, one end of the tubular bib structure is sealingly affixed about the inner surface of the tubular body portion 12 of the hood 11 intermediate the closed end and the open end thereof and on the opposite side of the optical lens panel 14 from such closed end. The tubular bib structure 16 extends in overlapping substantially coaxial relation within the tubular body portion 12 of the hood 11 and projects a substantial distance from the open end thereof.

Referring to FIG. 2, it will be seen that the hood 11 according to one embodiment of the teaching of the above-mentioned prior co-pending application is provided with a neck engaging air distribution cuff or ruff 18 and with a head engaging support band 19. Thus the hood 11 is mounted on the head of the wearer and will turn with the head of the wearer. The inner periphery of the ruff 18 bears against the neck of the wearer which is relatively stationary during turning movements of the head of the wearer. Such ruff has sufficient radial flexibility to enable rotational movement of the hood with the head of the wearer and avoid inconvenience and discomfort in use.

Figure 3:
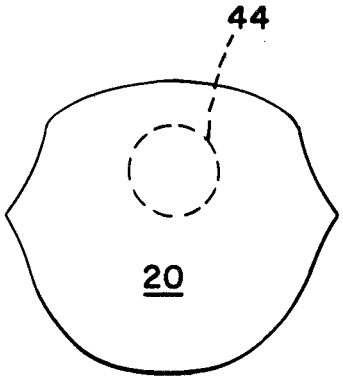
FIG. 3 is a plan view of the front portion of the inner bib according to the improvement of this invention.
Figure 4:
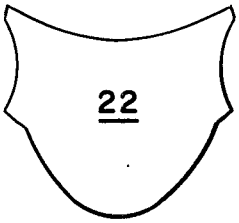
FIG. 4 is a plan view of the rear portion of the inner bib according to the improvement of this invention.

According to the embodiment 10 of the improvement of this invention, the inner bib structure 16 is passed through the inner periphery of the ruff 18 and sealingly mounted thereto. Since the ruff 18 is in turn sealingly mounted to the internal surface of the hood 11, the ruff 18 provides the sealing interconnection between the end of the inner bib structure 16 and the internal surface of the hood 11. Thus the end of the inner bib structure 16 will be in contact with the relatively stationary surface of the neck of the wearer together with the ruff 18 and will cooperate therewith in accommodating stresses resulting from rotational movement of the head-mounted hood 11. As shown in FIGS. 3 and 4, the inner bib 16 comprises a front panel 20 and a rear panel 22 which are sealingly affixed to each other along their side edges as indicated by the seam 21 in FIG. 1.

Figure 5:
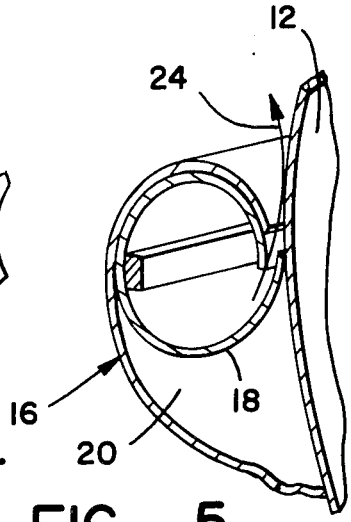
FIG. 5 is an enlarged fragmentary cross-sectional view showing the sealing attachment of the inner bib to the internal surface of the outer bib by means of the ruff according to the first embodiment of this invention.

Referring to FIG. 5, an enlarged fragmentary cross-sectional view is shown illustrating the attachment of the bib structure 16 to the ruff 18. The cross-section of FIG. 5 is taken immediately beneath the optical lens 14 and shows the opening through which respirable air is admitted into the hood 11 as indicated by the arrow 24.

As best shown in FIG. 2, respirable air is supplied to the ruff structure 18 through a hose 26 connected to an appropriate source of pressurized respirable air. The hose 26 passes between the inner bib structure 16 and the outer bib portion 28 of the hood 11 and communicates with the ruff 18 at the nape of the neck of the wearer. Since the nape of the neck of the wearer remains substantially stationary during normal head movements of the wearer, the hose 26 will not tend to inhibit such head movements and instead, the hood 11 will tend to pivot about the end of the hose 26 during normal head movements of the wearer. Furthermore, the fact that the hose 26 need not pass within the body covering apparel of the wearer as in the prior art, will provide greater freedom of body movement of the wearer while at the same time avoiding the necessity of providing an opening through the body covering apparel of the wearer to accommodate the hose. The interconnection of the hose 26 with the ruff 18 is well protected by the bib portion 28 of the hood against any air-borne contaminants that might otherwise tend to permeate such interconnection.

Figure 6:
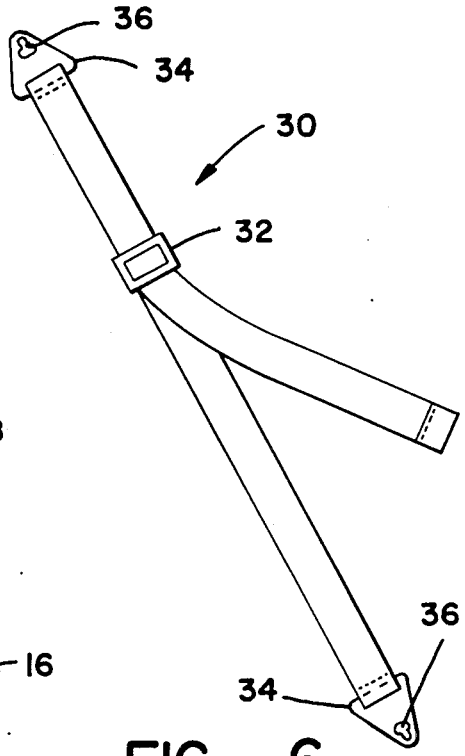
FIG. 6 is a plan view of a strap suitable for use with the first embodiment of the protective respirator hood according to the improvement of this invention.

Referring to FIG. 6, a plan view of a flexible, non-stretchable strap 30 made of fiber webbing, for example, which may be used to firmly mount the improved embodiment 10 of the hood 11 to the head of the wearer is shown. The strap 30 preferably includes means 32 for adjusting the length thereof. The opposite ends of the strap 30 are provided with attachment members 34 which may be affixed to the optical lens 14 by means of large headed plastic pins or buttons 35 passing through the slots 36 therein and through holes 38 provided at the upper edge of each end of the optical lens 14 (see FIGS. 1 and 2).

Figure 7:
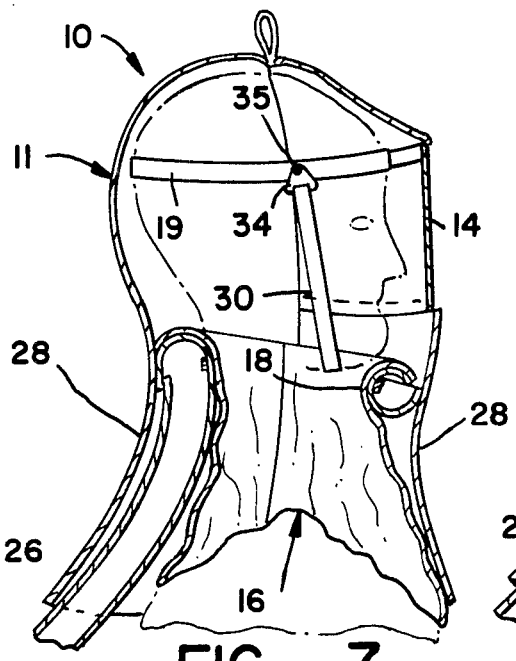
FIG. 7 is a perspective view broken away to show the strap in use as a chin strap with a protective respirator hood according to the first embodiment of the improvement of this invention.
Figure 8:
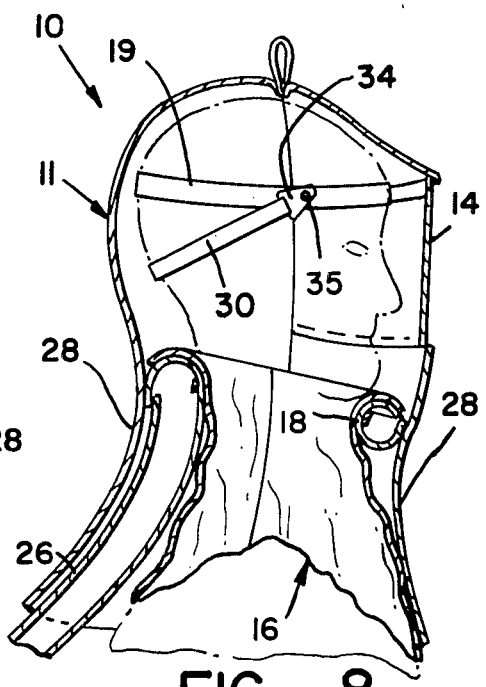
FIG. 8 is a perspective view partially broken away to show the strap in use as an internal nape strap with a protective respirator hood according to the improvement of this invention.

As shown in FIGS. 7 and 8, the headband 19 is mounted within the hood 11 by means of a pair of large headed plastic pins or buttons 35 at each end of the top edge of the optical lens 14. The attachment members 34 of the strap 30 are captured by one of the pairs of buttons at opposite ends of the optical lens 14. As shown in FIG. 7, the strap member 30 may be worn as a chin strap to hold the headband 19 firmly on the head of the wearer. Alternatively, as shown in FIG. 8, the strap 30 may be worn as a nape strap to insure that the headband 19 and hood 11 are firmly mounted on the head of the wearer.

Figure 9:
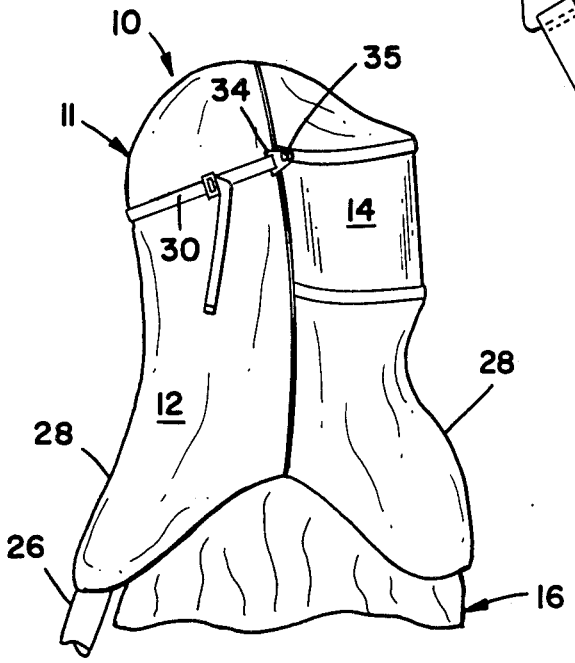
FIG. 9 is a perspective view showing the strap in use as an external nape strap with a protective respirator hood according to the improvement of this invention.

Finally, as shown in FIG. 9, the strap 30 may be mounted on the exterior of the hood 11. Again, the attachment members 34 at opposite ends of the strap member 30 may be mounted on one of the pair of plastic buttons or pins 35 at opposite ends of the optical lens 14. Where the strap 30 is mounted on the exterior of the hood 11, it is worn as a nape strap holding the rear of the hood 11 firmly against the rear of the head of the wearer and insuring a secure mounting of the headband 19 on the head of the wearer. Thus it will be seen that the hood 11 will move with the head of the wearer and any attempt to attach the outer bib 28 of the hood 11 to the body covering apparel of the wearer would result in an uncomfortable and inconvenient restraint on head movements of the wearer. The inner bib 16 according to the improvement of this invention provides a means by which the hood 11 may be attached to the body covering apparel of the wearer without introducing any discomfort or inconvenience in connection with head movements of the wearer.

Alternatively, as indicated by the dotted lines 31 in FIG. 2, a strip of elastic webbing may be affixed to the inner surface of the body 12 of the hood 11 in an expanded state and positioned to engage the nape of the neck of the wearer. Thus, in use the strip of elastic webbing will resiliently urge the back of the body 12 of the hood 11 against the nape of the neck of the wearer holding the head band 19 firmly in place.

Figure 10:
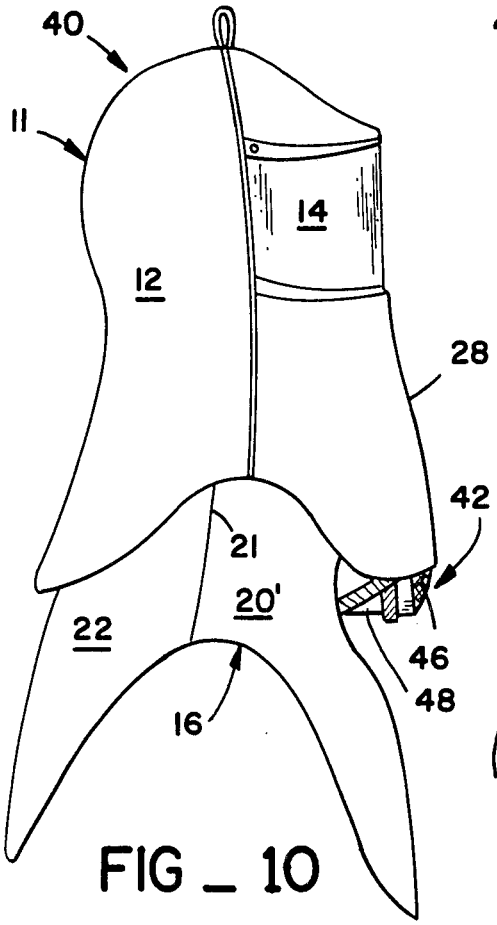
FIG. 10 is a side view in elevation of a second embodiment of the protective respirator hood according to the improvement of this invention prior to being donned by the wearer.

Referring to FIG. 10, an alternate embodiment 40 of the improvement of this invention is shown prior to donning by the wearer. The hood structure 11 of the embodiment 40 is identical to the hood structure 11 of the embodiment 10 and the same reference numerals have been used for corresponding parts. According to the embodiment 40, a face mask 42 is mounted through the front panel 20' of the inner bib structure 16. To this end a circular opening about eleven centimeters in diameter is provided through the front panel 20' as indicated by the dotted line 44 in FIG. 3.

Figure 11:
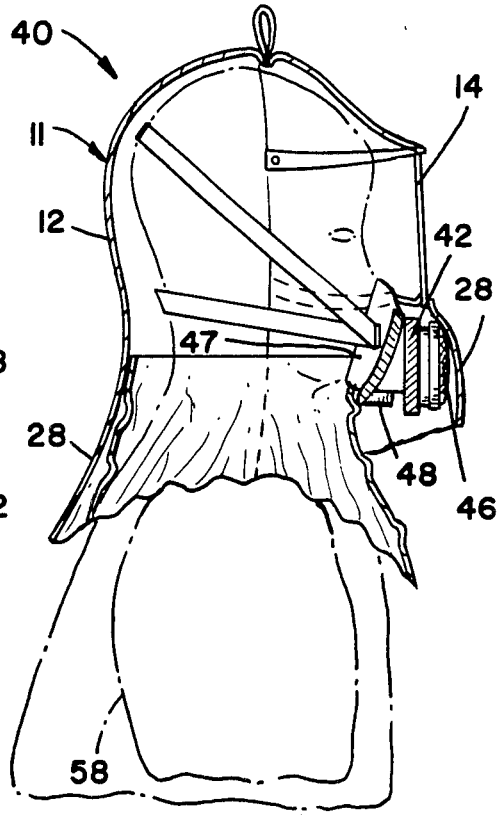
FIG. 11 is a cross-sectional view of FIG. 10 showing the second embodiment of the protective respirator hood according to the improvement of this invention after being donned by the wearer.

The face mask 42 is mounted through the front panel 20' of the bib structure 16 with the intake port or filter 46 and exhaust port 48 on the outside of the bib structure 16. As best shown in FIG. 11, the face engaging portion 47 of the face mask 42 is located on the interior of the bib structure 16. As also shown in FIG. 11, the neck engaging ruff is omitted in the embodiment 40 and the inner end of the inner bib structure 16 is sealingly attached directly to the interior surface of the body 12 of the hood 11.

Figure 12:
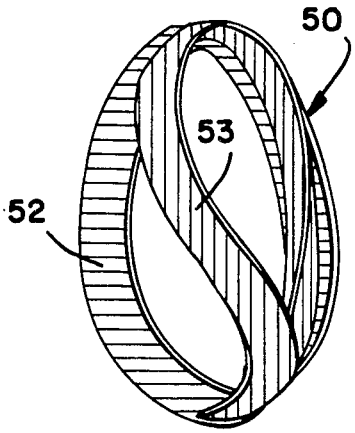
FIG. 12 is an enlarged fragmentary perspective view showing the intake port and exhaust port of a face mask as mounted through the front portion of the inner bib according to the improvement of this invention.

FIG. 12 is an enlarged fragmentary view showing the mounting of the face mask 42 through the opening 44 in the front panel 20' of the inner bib structure 16. The periphery of the opening 44 is provided with an elastic band structure 50 constructed and dimensioned to provide a resilient seal between the face mask 42 and the front panel 20' of the inner bib structure 16. The face mask 42 shown in FIGS. 10 through 12 is of relatively simple construction having a substantially cylindrical body portion that may be easily accommodated by a simple elastic band structure 50.

However, according to the embodiment 40 of the improvement of this invention, an elastic band structure 50 is provided which can accommodate a variety of face mask structures. The details of such elastic band structure 50 are shown in FIG. 13.

Thus the elastic band structure 50 comprises a first strip 52 of conventional elastic webbing about twenty-five centimeters long and two centimeters wide formed into a cylindrical ring with the ends thereof fixed to each other in circumferentially overlapped relation. A second strip 53 of elastic webbing about twenty-five centimeters long and two centimeters wide is formed into a U-shaped configuration with both legs thereof rotated in the same direction and fixed to each other in overlapping relation with the inside of both legs facing the same side of the structure. The overlapping ends of the strip 53 and the bight thereof are then fixed to diametrically opposed points on the circular strip 52. The circular strip 52 is in turn sealingly affixed in an expanded state about the periphery of the opening 44 in the front panel 20' of the bib structure 16. The elastic strips 52, 53 may be of the type sold by J. P. Stevens Company, Inc. part No. N3-5530 DC Natural.

Figure 13:
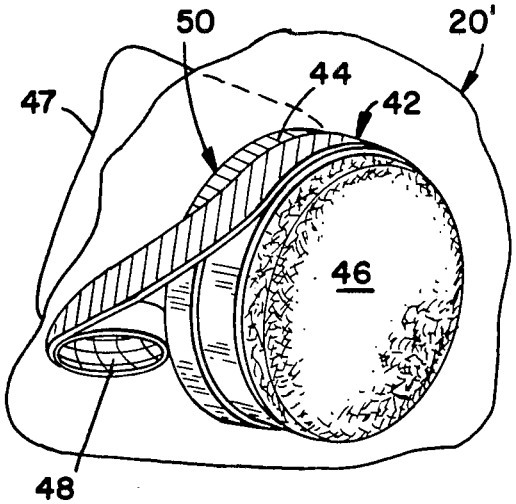
FIG. 13 is an enlarged perspective view of the elastic mounting structure provided in the front portion of the inner bib according to the second embodiment of the improvement of this invention for mounting various face masks to the front portion of the inner bib.
Figure 14:
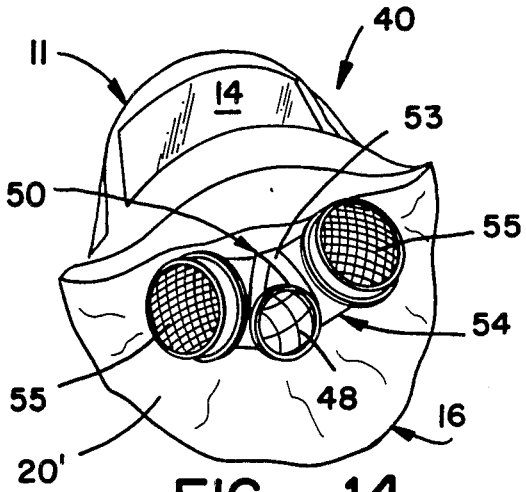
FIG. 14 is a reduced perspective view showing the intake ports and exhaust ports of an alternate face mask as mounted through the front portion of the inner bib according to the second embodiment of the improvement according to this invention.
Figure 15:
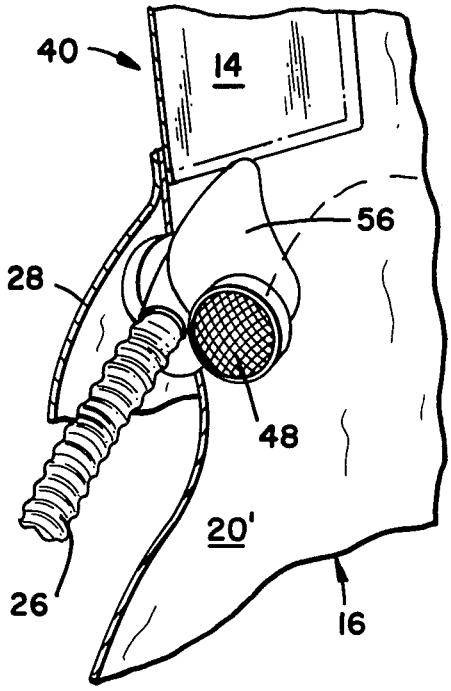
FIG. 15 is a fragmentary view, partially in section showing a supplied air face mask as mounted through the front portion of the inner bib according to the second embodiment of the improvement according to this invention.

It has been found that the elastic band structure 50 as shown in FIG. 13 and described hereinabove can accommodate a wide variety of half and full face mask structures. For example, as shown in FIG. 14, the strips 52 and 53 will provide elasticized openings which cooperate to provide a secure attachment for a complicated face mask 54 having a pair of intake filters 55 and a common exhaust port 48. It will be understood that both elastic strips 52 and 53 will engage the cylindrical external surface of the face mask 42 or the external surface of any other face mask having a regular shape. However, the elastic band structure 50 is also capable of adapting itself to a wide variety of irregular shapes including a supplied air mask 56 as shown in FIG. 15.

Since the hood structure 40 is firmly attached to the face of the wearer by means of the face mask, it will turn with the head of the wearer. The inner bib structure 16 in accordance with this invention is flexible and flaccid to enable free movement of the head of the wearer without discomfort or inconvenience even when tucked into or attached to the body covering apparel of the wearer.

Figure 16:
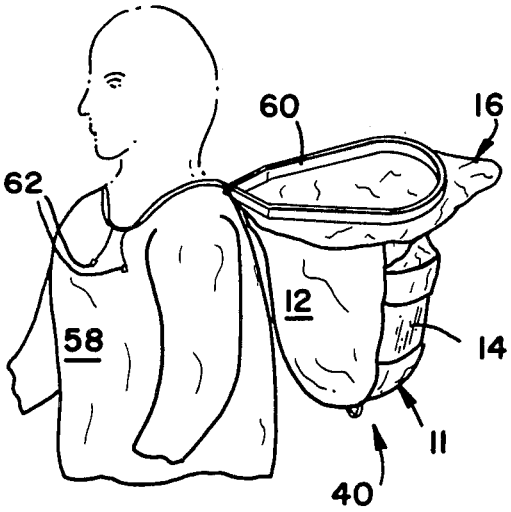
FIG. 16 is a perspective view showing a protective respirator hood according to the second embodiment of the improvement of this invention as adapted for sealing to the body covering apparel of the wearer.
Figure 17:
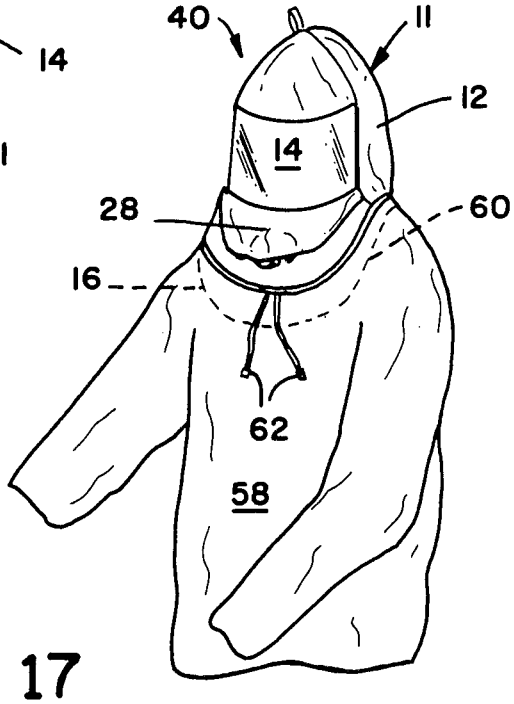
FIG. 17 is a perspective view illustrating a preferred sealing interconnection between the inner bib of the protective respirator hood according to the second embodiment of the improvement of this invention and the body covering apparel of the wearer.

Thus, referring to FIGS. 16 and 17, the inner bib structure 16 may be sealingly attached to the body covering apparel or protective suit 58 of the wearer without discomfort or inconvenience. For example, a rigid neck ring 60 may be sealingly attached within the inner bib structure 16 and the neck ring 60 may be attached at the rear to the back of the neck portion of the body covering protective suit 58 of the wearer to enable quick and convenient assembly of the hood structure with the body covering apparel 58 of the wearer. As shown in FIG. 16, the neck portion of the body covering apparel or suit 58 of the wearer may be provided with a drawstring 62 and when the inner bib structure 16 is tucked within the neck of the body covering apparel 58, the drawstring 62 may be pulled tight so that the neck of the body covering apparel 58 is directed into sealing engagement with the inner bib structure 16 and the rigid neck ring 60 attached to the interior of the inner bib structure 16.

In use, the embodiment 40 of the improved hood according to this invention is assembled with the rigid neck ring 60, attached to the body covering apparel 58 at the back of the neck portion thereof only (see FIG. 16) and stored for donning together with the desired face mask when needed. In the event of need, the face mask is donned first to provide for safe respiration. The body covering apparel 58 is then donned and the hood 40 pulled over the head providing substantial initial protection.

The inner bib structure 16 is tucked into the neck opening of the body covering apparel (see FIG. 17) and the drawstring 62 pulled tight to seal the neck opening of the body covering apparel 58 to the inner bib 16 by means of the rigid neck ring 60. The face mask is then assembled with the inner bib structure 16 by pulling the elasticized opening over the inlet filters and exhaust port of the face mask so that they are on the outside of the inner bib structure 16. The elastic band structure 50 is positioned about the body of the face mask to provide a seal therewith and to firmly attach the inner bib structure 16 to the face mask so that the hood 40 will turn comfortably and conveniently with the head of the wearer. The open end of the outer hood structure 28 is then pulled down over the projecting intake filters and exhaust port of the face mask to protect them and the seal areas from air-borne particulate matter.

It is believed that those skilled in the art will make obvious modifications in the preferred embodiments of this invention as shown in the drawing and described hereinabove without departing from the scope of the following claims.

What is claimed is:

1. In a head mounted hood including a hollow generally tubular body portion with a closed end and an open end made of flaccid, non-stretchable, air-impervious material dimensioned to enclose the head and neck of the wearer and having an optical lens panel interposed in the wall adjacent said closed end thereof, the improvement comprising an elongated open ended generally tubular bib structure of flaccid, non-stretchable, air-impervious material dimensioned to be received over the head of the wearer and having one end sealingly affixed about the inner surface of said tubular body portion intermediate said closed end and said open end thereof on the opposite side of said optical lens panel from said closed end of said tubular body portion, said tubular bib structure extending in overlapping substantially coaxial relation within said tubular body portion and projecting a substantial distance from said open end thereof, and including an opening through said tubular bib structure beneath said optical lens panel, centered with respect to said optical lens panel and spaced from said one end of said tubular bib structure, and the opening being dimensioned to receive the intake port and exhaust port of a face mask therethrough and having an elastic band structure sealingly affixed about the periphery thereof in an expanded state.

2. The improvement of claim 1 wherein said elastic band structure comprises a first strip of elastic webbing formed into a cylindrical ring with the ends thereof affixed in an expanded state about the periphery of said opening through said bib structure.

3. The improvement of claim 2 wherein said elastic band structure includes a second strip of elastic webbing formed into a U-shaped configuration with the legs thereof rotated so that the inside surfaces thereof face a given side of said configuration, the ends of said legs being fixed to each other in overlapping relation, the bight of said U-shaped configuration and said overlapping ends of said legs thereof being fixed to diametrically opposed points on said cylindrical ring formed of said first strip of elastic webbing.

4. The improvement of claim 3 wherein said opening through said tubular bib structure has a diameter of about eleven centimeters and said first and second strips of elastic webbing each have a length of about twenty-five centimeters and a width of about two centimeters.

5. A head mounted protective respirator hood adapted to move with the head of a wearer, comprising:

a hollow generally tubular body portion of the hood, with a closed top end and an open bottom end, formed of a flaccid, air-impervious material and dimensioned to fit over and enclose the head and neck of the wearer and having an optical lens panel positioned in a front wall of the body portion in the path of the wearer's vision;

said tubular body portion having outer bibs or flaps extending down from the hood body portion and being dimensioned so as to fit over the front and back exterior of the wearer's clothing;

a generally tubular inner bib of flaccid air-impervious material dimensioned to be received over the head of the wearer and having an upper end adapted to be secured to the inner surface of the body portion at a location intermediate the ends thereof and having an open lower end, the inner bib depending partially co-extensively with the outer bib but being of substantially greater length than the outer bib and extending lower than the outer bib;

the inner and outer bibs defining an annular space between them and said upper end of the inner bib being located high enough that the inner bib is adapted to be worn under the wearer's clothing with the clothing extending into the annular space between the bibs;

an annular, generally tubular air distribution ruff extending around the inner bib at the upper end thereof and in sealed connection therewith, and positioned between the inner bib and the outer bib and in sealed connection to the hood body portion at said intermediate location, and including an air outlet at the front of the ruff positioned to deliver air from the ruff to the interior of the hood just below the optical lens panel for breathing by the wearer, and also including a supply hose connected at the back side of the ruff and extending downwardly between the outer and inner bibs so as to be positioned outside the wearer's clothing but inside the outer bib, for extending to a connection with a source of supply air;

means for causing the body portion of the hood to move along with the wearer's head; and the inner bib being in sealed relationship to the hood body portion and the body portion and inner bib being without air exhaust openings except for the open lower end of the inner bib, so that the wearer's exhaled air and excess supply air are exhausted through the lower end of the inner bib and within the wearer's clothing.

6. The respirator hood of claim 5, wherein the air distribution ruff is formed of flaccid, air-impervious material similar to that of the body portion and the bibs.

7. The respirator hood of claim 5, wherein the means for causing the body portion to move comprises a head engaging band affixed to opposite ends of the optical lens panel within the hood, and means for holding the band in engagement with the head of the wearer.

* * * * *